United States Patent [19]

Kaufman

[11] Patent Number: 5,016,514

[45] Date of Patent: May 21, 1991

[54] CAPO FOR STRINGED INSTRUMENTS

[76] Inventor: Jay S. Kaufman, 138 W. Glaucus St., Encinitas, Calif. 92024

[21] Appl. No.: 562,827

[22] Filed: Aug. 6, 1990

Related U.S. Application Data

[63] Continuation-in-part of Ser. No. 492,483, Mar. 12, 1990, abandoned.

[51] Int. Cl.[5] ..... G10D 3/04

[52] U.S. Cl. ..... 84/318

[58] Field of Search ..... 84/318

[56] References Cited

U.S. PATENT DOCUMENTS

| | | | |
|---|---|---|---|
| 3,191,480 | 6/1965 | Lowe | 84/318 |
| 4,304,165 | 12/1981 | Gould | 84/318 |
| 4,412,472 | 11/1983 | Welch | 84/318 |
| 4,475,433 | 10/1984 | Williamson et al. | 84/318 |
| 4,753,147 | 6/1988 | Berardi | 84/453 |
| 4,856,404 | 8/1989 | Hughes | 84/297 R |

FOREIGN PATENT DOCUMENTS

| | | | |
|---|---|---|---|
| 277458 | 9/1927 | United Kingdom | 84/318 |

*Primary Examiner*—Lawrence R. Franklin

*Attorney, Agent, or Firm*—Baker, Maxham, Jester & Meador

[57] ABSTRACT

A capo for detachably mounting on the neck of a fretted stringed musical instrument for selectively raising the pitch of the instrument comprises an elongated spring bar having a length for extending across and engaging the strings on the neck of an instrument, an elongated elastic tension member connected to opposite ends of the spring bar and extending across the back of the neck of the instrument for pulling the strings into engagement with the frets of the instrument, and an elongated elastic cover for extending over and covering the spring bar and for extending over and covering the elastic tension member.

18 Claims, 2 Drawing Sheets

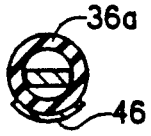
FIG. 5
FIG. 4
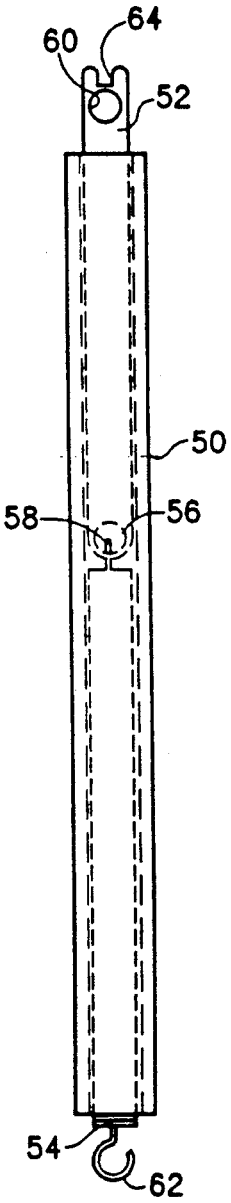
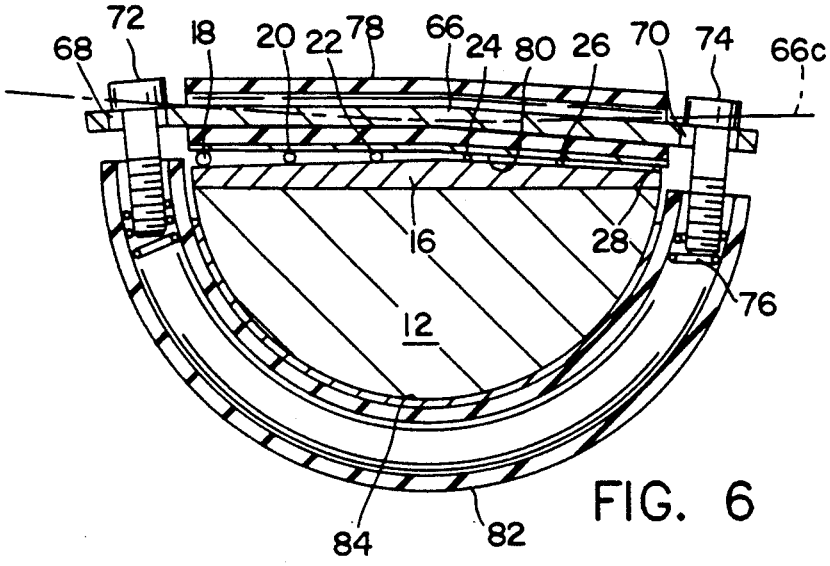
FIG. 6
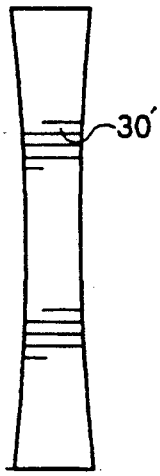
FIG. 7
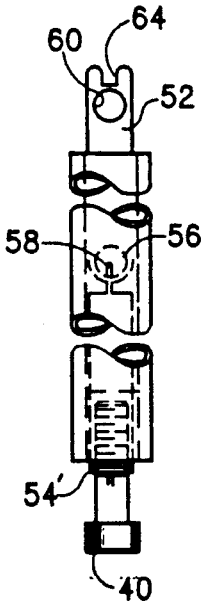
FIG. 8

CAPO FOR STRINGED INSTRUMENTS

REFERENCE TO RELATED APPLICATION

This is a continuation-in-part of my co-pending application Ser. No. 07/492,483, filed Mar. 12, 1990, now abandoned, entitled "Capo For Stringed Instruments".

BACKGROUND OF THE INVENTION

The present invention relates to attachments for stringed instruments and pertains particularly to an improved capo for fretted stringed instruments.

It is frequently desirable to raise the pitch of the strings of fretted stringed musical instruments. This is typically accomplished by means of a device called a capotasto, usually referred to as a capo. A capo is typically a device which is clamped across the strings for pulling and clamping the strings to the frets which are embedded in the finger board or neck of the instruments. This shortens the effective vibrating length of the strings, and thereby raises the pitch thereof.

The prior art capos typically employ a straight rigid bar for extending across the strings, with a strap extending behind the neck of the instrument for securing the bar in place. The bar is moved to various fret locations along the finger board for selectively raising the pitch of the instrument. Relatively large forces are required to simultaneously clamp all strings with a straight rigid bar due to the adverse profile imposed by the tops of the strings. Several devices have been devised to increase the clamping force to effectively clamp the strings to the frets. These, however, tend to be unwieldy and unreliable, and require unusual manual dexterity to use. These prior art devices must be removed or loosened to change position along the finger board and then retightened. When not in use, they are typically removed from the instrument and temporarily stored.

In my prior application, I disclose an improved capo having a spring bar that deflected and progressively applied pressure to the strings to bias them into engagement with the frets. The bar included variations in the cross sectional configuration to vary the stiffness of the bar along the length thereof. The application also disclosed improved sheaths for the capo. I have discovered further improvements in bar configuration and sheaths that are incorporated herein.

It is desirable that the capo be capable of biasing all of the strings uniformly into engagement with the frets, and be simple and easy to move to selective locations along the neck of the instrument.

SUMMARY AND OBJECTS OF THE INVENTION

It is the primary object of the present invention to provide an improved capo for fretted stringed instruments.

In accordance with a primary aspect of the present invention, a capo for raising the pitch of a fretted stringed musical instrument comprises an elongated spring bar for extending across the strings of an instrument, an elongated elastic sheath combination having a section with a length for extending over the bar and a second section for encircling the neck of the stringed instrument, and elongated elastic means connected to opposite ends of the spring bar and extending across the back of the neck of the instrument for pulling the spring bar into engagement with the strings, and the strings into and against the frets of the instrument.

BRIEF DESCRIPTION OF THE DRAWING

The above and other objects and advantages of the present invention will become apparent from the following description when read in conjunction with the accompanying drawings wherein:

FIG. 4 is a top plan view of an alternate embodiment of the invention;

FIG. 5 is a section view taken on line 5—5 of FIG. 3;

FIG. 6 is a view like FIG. 2 illustrating another embodiment of the invention;

FIG. 7 is a top plan view of an alternate embodiment of the spring bar; and

FIG. 8 is a top plan view of a still further embodiment of the invention.

DETAILED DESCRIPTION OF A PREFERRED EMBODIMENT

Figure 1:
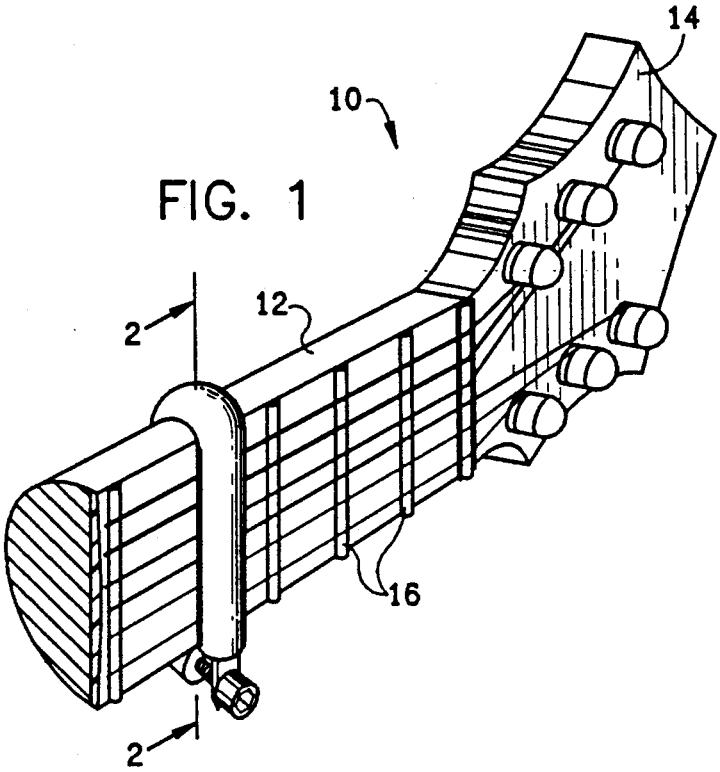
FIG. 1 is a perspective view illustrating a preferred embodiment of the invention in use.
Figure 2:
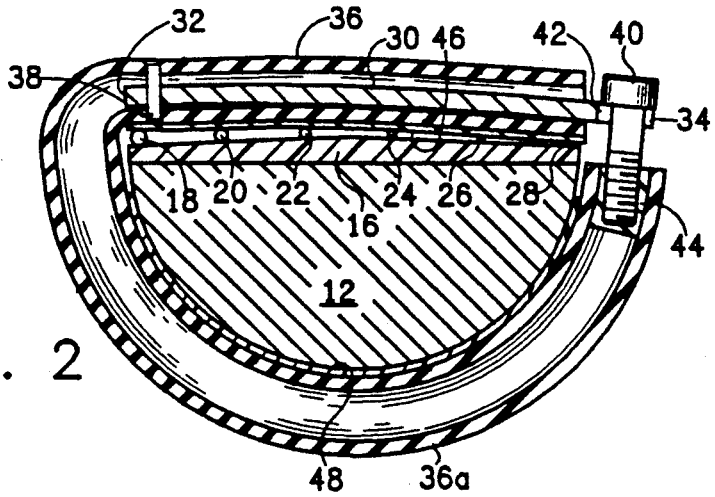
FIG. 2 is a section view through a neck of a stringed instrument.

Referring to the drawings, and particularly to FIG. 1, there is illustrated an exemplary embodiment of a capo in accordance with the invention shown in use on the neck of a typical stringed instrument, designated generally by the numeral 10. As illustrated in FIG. 1, a neck 12 of an instrument has a head 14, with a finger board formed by a generally flat surface of the neck having a plurality of frets 16 mounted thereon in spaced relation in a conventional fashion. The instrument, as illustrated in FIG. 2, illustrates a curved upper surface to the frets 16, with a plurality of spaced apart strings 18, 20, 22, 24, 26 and 28 aligned over and across the frets. The curved fret adds to the difficulty with the use of prior art devices.

Figure 3:
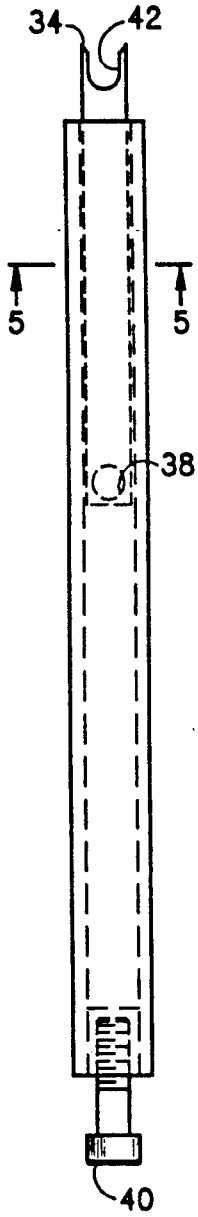
FIG. 3 is a top plan view illustrating the embodiment of FIG. 1.

Referring to FIGS. 1–3, an exemplary embodiment of a capo in accordance with the invention is illustrated. The capo comprises an elongated flat spring bar having a length sufficient to span the strings of the instrument, with an end 32 connected to an elongated elastic member, which will be described, which extends around the neck of the instrument and connects to another end 34 of the spring bar. The spring bar 30 may be constructed of any suitable material, but is preferably constructed of a spring steel of C 1075 steel. The spring bar, in accordance with a preferred embodiment of the invention, is on the order of approximately 0.050 inches in thickness and approximately 0.25 inches in width. The width can vary, as will be subsequently explained, to provide a varying stiffness along the length of the spring bar for accommodating certain curvature conditions at different fret positions, and distributing force uniformly to or across the strings, as will be explained.

The spring bar member may be constructed of other suitable materials, but preferably has a stiffness or spring rate to apply approximately eight to twelve pounds of force to the strings, and to conform by such force to any curvature of the finger board while applying force uniformly to each string. The overall unit is constructed such that the force applied may vary from approximately eight pounds at the first fret up to about twelve pounds at the sixth fret. It will be appreciated that the neck of most instruments vary in cross sectional configuration between the head and body of the instrument. The cross section tends to increase from the head toward the body. This variation in cross section varies with various instruments, and the structure of the present capo takes this into consideration.

The spring bar 30 is covered in or mounted within one end of an elongated elastic tube, which in this embodiment serves not only as a covering but also as the elastic member or means for applying the force to the ends of the spring bar. The elongated tubular member has a first portion 36, which extends over and covers the bar 30, with a second portion 36*a* that extends from the end of the bar around the neck of the instrument to the opposite end of the bar and is connected thereto. The elongated elastic tubular member is preferably connected to end 32 by means of a brad or rivet 38, and is connected to the opposite end of the bar by means of a screw member 40, which extends into a slot 42 in the end of the spring bar 30, and threadably engages a threaded insert 44 within the end of the tubular member 36.

The elongated tubular member 36 may be constructed of any suitable material having the desired durability and elasticity to accommodate the movement of the capo along the neck of the instrument, and to apply forces to the ends of the spring bar 30 of between about eight and twelve pounds. I have found a preferred material to be polyurethane, with a second choice being that of ethylene-propylene. A first low friction surface 46 is provided along the top section of the tube, with a second low friction surfacing 48 provided on the surface that extends around and engages the neck of the instrument, as shown in FIG. 5. This low friction surface or coating is common to all embodiments of the invention. The screw 40 may be selectively adjusted to adjust the tension in the section 36*a* of the tube.

The low friction surface 46 and 48 may be formed by one continuous strip or a coating or by other means. A suitable form of low friction surfacing is formed by the application of an ultra high molecular weight polyethylene tape thereto. This tape provides a wear resistant surface against the strings, and it also provides a low friction surface against the neck of the instrument to enable it to be easily moved along the neck of the instrument.

It is also possible to provide the low friction surface by incorporating a lubricant into the tubing, such as a moly-disulfide or by a coating of Teflon. A Teflon coating, if used, would be only on that portion of the tube which wraps around the neck of the instrument, since it would not wear well over the strings.

Referring to FIG. 4, an alternate embodiment is illustrated wherein an elongated tubular sheath 50, as in the previous embodiment, extends over a spring bar 52 and also over an elongated spring member in the form of a coil spring 54. In this embodiment, the spring bar 52 is provided at one end, with an eyelet 56 for receiving a hook 58 of an elongated coil tension spring 54. The opposite end of the bar is provided with an eyelet 60 for receiving a hook 62 on the opposite end of the tension spring 54, and with a notch 64 for preventing rotation of the spring 54 as the capo is moved along the neck of the instrument. The coil spring 54 is preferably pre-tensioned to have about three pounds of force that remains substantially constant over a necessary range of stretch. The tubular sheath 50 extends over the spring bar member 52 and over the coiled tension spring member 54. The sheath is provided with low friction surfaces as previously described.

This is a preferred embodiment of the invention where the neck of the instrument varies any significant amount in cross section along the length thereof. This embodiment enables one to obtain a more uniform force on the strings of the instrument, with movement of the capo along the neck of the instrument. This is particularly desirable with a modification, as will be subsequently explained, wherein a spring bar varies in cross section along its length to more easily conform to any curvature of the finger board of the instrument.

Referring to FIG. 6 of the drawing, there is illustrated a still further embodiment, now considered the preferred embodiment of the invention. This embodiment is illustrated like FIG. 2 wherein the same elements are identified by the same numerals, and equivalent or like elements are given their own numerals. As illustrated, an elongated spring bar 66 is provided with bores 68 and 70 at the opposite ends thereof for receiving a pair of tension screws 72 and 74. The ends of the bar 66 are preferably bent downwardly, up to about twenty degrees to provide better alignment of screws 72 with the spring 76. The bar 66 is preferably bent or curved wherein the center is displaced about forty thousandths (0.040") toward the neck from the ends. The bar is curved or concave away from the curvature of the neck of the instrument before tensioning, as shown by centerline 66*c*. Thus, the center of the bar engages the strings first and is pulled down progressively toward the ends, applying substantially uniform force to the strings.

In this embodiment, the tension or elastic forces applied to the ends of the bar 66 are accomplished by means of the elastic spring member 76 in the form of a coil tension spring, which is selected to apply a force of between eight and twelve pounds to the ends of the bar 66. The spring is attached to the bar by means of a pair of screws 72 and 74 extending through holes 68 and 70 in the ends of the bar, and threadably extending into the ends of the elastic spring member 76. The screws enable the tension in the spring and bar to be adjusted to an extent by extending the screws further into the ends of the spring. The screws (at least one, 74) preferably have knurled heads to enable finger rotation and adjustment thereof. The other screws may be covered by an elastomer cap 82. The bar 66, as illustrated, is biased by the spring 76 to conform to the curvature of a line across the top of the strings.

A sleeve 78 preferably formed of polyurethane fits over and covers the bar and engages the strings. The sleeve may also have a coating or tape 80 of polyurethane or ultra high molecular weight polyethylene, particularly if formed of other materials. An elongated tubular sleeve 82 extends over and covers the spring 76 for engaging and protecting the finish of the neck 12 of the instrument. This sleeve may also be made of another material and have a Teflon or ultra high molecular weight polyethylene tape 84 along the length thereof for engaging the surface of the neck.

Referring to FIG. 7, an alternate embodiment of the spring bar is illustrated wherein the spring bar 30' varies in cross-section along the length thereof to vary the spring force or flexure along the length thereof. As illustrated, the width varies with a uniform thickness. The bar decreases in width from the ends to the center. The bar may also vary in thickness with a uniform width with the same effect. This gives varying flexibility to the spring bar over its length to enable it to distribute a more uniform force along its length at different fret positions.

Referring to FIG. 8, a modified version of the FIG. 4 embodiment is illustrated. A screw 40 extends through hole 60 in spring bar 52 and into threads in the end of coil spring 54'. This enables an adjustment in the tension of coil spring 54'. This notch 64 in spring bar 52 may be eliminated. The FIG. 4 and FIG. 8 embodiments are preferred, because the tension in springs 54 and 54' remain essentially constant over time. They can also be selected with a pre-set tension which will remain more uniform over time.

While I have illustrated and described my invention by means of specific embodiments, it is to be understood that numerous changes and modifications may be made therein without departing from the spirit and scope of the invention as defined in the appended claims.

I claim:

1. A capo for raising the pitch of a fretted stringed musical instrument having an elongated neck, comprising:

an elongated spring bar for extending across the strings of an instrument and shaped for uniformly distributing force thereto for progressively biasing all strings into engagement with frets on the neck of the instrument, said elongated spring bar varying in width along the length thereof for varying the spring rate over the length thereof;

an elongated elastic sheath means having a first portion for extending over said bar and a second portion for encircling the neck of a stringed instrument; and elongated elastic means connected to opposite ends of the spring bar and extending across the back of the neck of the instrument for pulling the spring bar into engagement with the strings and the strings into and against the frets of the instrument.

2. A capo according to claim 1 wherein:

said elongated spring bar is formed to curve away from the neck of the instrument until biased by said elastic means into engagement with the strings of the instrument.

3. A capo according to claim 1 wherein:

said elongated elastic means comprises a coiled tension spring having first means on one end thereof for connecting to one end of said spring bar, and second means on the other end for connecting to the other end of the spring bar.

4. A capo according to claim 3 wherein:

said first and said second connecting means comprises a screw threadably extending into the respective ends of said coiled tension spring.

5. A capo according to claim 4 wherein:

said first portion of said sheath means has a wear resistant surface for engaging said strings and said second portion has a low friction surface for engagement with said instrument neck.

6. A capo according to claim 5 wherein:

said wear resistant surface is defined by a polyurethane or ultra high molecular weight polyethylene surface and said low friction surface is defined by a Teflon or ultra high molecular weight polyethylene surface of said sheath.

7. A capo according to claim 1 wherein:

said sheath has a wear resistant surface for engaging said strings and a low friction surface for engagement with said instrument neck.

8. A capo according to claim 7 wherein:

said wear resistant surface is defined by a polyurethane or ultra high molecular weight polyethylene surface and said low friction surface is defined by a Teflon or ultra high molecular weight polyethylene surface of said sheath.

9. A capo for mounting on the neck of a fretted stringed musical instrument for selectively raising the pitch of the instrument comprising:

an elongated spring bar having a length for extending across the strings on the neck of an instrument and a curved configuration for uniformly distributing force thereto;

an elongated elastic means extending from one end of the bar and extending across the back of the neck of the instrument for pulling the bar into the strings and the strings into and against the frets of the instrument, said elongated elastic means comprising a coiled tension spring having a first screw on one end thereof for connecting to one end of said spring bar, and a second screw on the other end for connecting to the other end of the spring bar; and elongated flexible cover means having a first portion with a wear resistant surface for extending over and covering said spring bar for engaging said strings, and a second portion with a low friction surface for extending over and covering said elastic member and engaging the neck of said instrument.

10. A capo according to claim 9 wherein:

said spring bar is curved away from the neck of the instrument so that the center of said spring bar engages the strings first.

11. A capo according to claim 10 wherein:

said spring bar varies in cross section from the ends to the center.

12. A capo according to claim 10 wherein:

said wear resistant surface is defined by a polyurethane or ultra high molecular weight polyethylene surface and said low friction surface is defined by a Teflon or ultra high molecular weight polyethylene surface.

13. A capo according to claim 10 wherein:

said wear resistant surface is defined by a polyurethane sheath and said low friction surface is defined by a Teflon sheath.

14. A capo for detachably mounting on the neck of a fretted stringed musical instrument for selectively raising the pitch of the instrument comprising:

an elongated spring bar having a length for extending across and a curved configuration for first engaging the center strings on the neck of an instrument and substantially uniformly distributing force thereto;

an elongated coiled spring tension member connected to opposite ends of said spring bar and extending across the back of the neck of the instrument for pulling the strings into engagement with the frets of the instrument; and elongated flexible cover means having a first portion with a wear resistant surface for extending over and covering said spring bar for engaging said strings, and a second portion with a low friction surface for extending over and covering said elastic member and engaging the neck of said instrument.

15. A capo according to claim 14 wherein:

said elongated elastic tension means comprises a coiled tension spring having first means on one end thereof for connecting to one end of said spring bar, and second means on the other end for connecting to the other end of the spring bar.

16. A capo according to claim 15 wherein:

said wear resistant surface is defined by a polyurethane sheath and said low friction surface is defined by a Teflon sheath.

17. A capo according to claim 14 wherein:

a first screw on one end of said coil spring for connecting to one end of said spring bar, and a second screw on the other end of said coil spring for connecting to the other end of the spring bar.

18. A capo according to claim 17 wherein:

said spring bar varies in cross-section from the center to the ends.

* * * * *